United States Patent [19]

Bhattacharya

[11] Patent Number: 4,817,862

[45] Date of Patent: Apr. 4, 1989

[54] CONTROL APPARATUS

[75] Inventor: Amor Bhattacharya, Plano, Tex.

[73] Assignee: Trans-Tech Industries, Inc., Plano, Tex.

[21] Appl. No.: 103,964

[22] Filed: Oct. 2, 1987

[51] Int. Cl.[4] ..... F23N 5/20

[52] U.S. Cl. ..... 236/10; 236/46 R

[58] Field of Search ..... 165/12; 236/46 R, 10, 236/11; 62/231

[56] References Cited

U.S. PATENT DOCUMENTS

| | | | |
|---|---|---|---|
| 3,940,634 | 2/1976 | Grogan | 307/311 X |
| 4,176,288 | 11/1979 | Komatsu et al. | 307/631 |
| 4,384,461 | 5/1983 | Kurtz | 62/231 X |
| 4,485,966 | 12/1984 | Cartmell et al. | 236/46 R |
| 4,509,585 | 4/1985 | Carney et al. | 236/46 R |
| 4,667,874 | 5/1987 | Johnson et al. | 236/10 |
| 4,694,890 | 9/1987 | Zarate | 236/11 X |

*Primary Examiner*—William E. Wayner

*Attorney, Agent, or Firm*—Kanz, Scherback & Timmons

[57] ABSTRACT

Control apparatus for controlling the operation of a gas valve in a gas heating system which includes thermostatic switch means and a source of AC voltage which are connected to form a series circuit with the gas valve is disclosed. The control apparatus comprises switch means which is connected to provide continuity in the series circuit upon receipt of a first control signal and to remove the continuity in the series circuit upon removal of the first control signal. Isolation means receives a second control signal having a high state and an alternate low state and generates the first control signal when receiving the high state of the second control signal. A power supply receives the AC voltage when the thermostatic switch means is closed and provides a DC voltage to a timer means. The timer means then generates the second control signal.

20 Claims, 5 Drawing Sheets

CONTROL APPARATUS

BACKGROUND OF THE INVENTION

1. Field of the Invention

The present invention relates in general to apparatus for controlling the application and removal of an AC voltage to an energy consuming device. More particularly, it relates to apparatus for controlling a system of the type which regulates the temperature in a space for the purpose of reducing the energy consumption thereof.

2. Description of the Prior Art

In recent years, with the increased emphasis on energy conservation, it has become more important to minimize consumption of energy in all facets of daily life. In particular, great improvements in efficiency can be realized in the heating and cooling of buildings.

Although the present invention is applicable to the control of various energy consuming devices, it has been found to be particularly useful in the control of the gas valve of a furnace. Therefore, without limiting the applicability of the invention to "gas valves for furnaces", the invention will be described in this environment.

In a temperature-control unit such as a conventional heating system of the type found in a home, office or warehouse, the heater or furnace portion includes a gas burner having a gas valve which is actuated in response to a thermostat located in an area to be heated. When the temperature detected by the thermostat is below a selected setting, the thermostat signals the gas valve to open, thereby allowing gas to flow into the gas burner where the gas is ignited by the pilot flame. Heat from the gas burner is used to heat a heat exchanger. A fan is turned on when a predetermined temperature is reached in the plenum chamber of the furnace and air is passed over the heat exchanger and distributed throughout the area to be heated via a duct system.

After a brief period of time, the heat exchanger reaches a relatively high temperature and air passing through the heat exchanger can not absorb all the heat from the heat exchanger. This heat which is not absorbed from the heat exchanger is discharged through the chimney system or flue rather than being absorbed by the air passing over the heat exchanger and represents a significant loss in total system efficiency.

Attempts in the prior art have been made to address the problem and U.S. Pat. No. 4,485,966 discloses a pulsation device for a heating or cooling unit which is connected in series with a low voltage AC power supply, a gas valve and thermostat for a heating or cooling system. The pulsation device includes a DC (direct current) power supply, a pulsating switch connected to conduct a substantial portion of the current directed through the thermostat and gas valve of the heating unit, timer means programmed to open and close the pulsating switch according to corresponding predetermined time periods and means connected to the pulsating switch for providing a small current flow through the gas valve of the heating unit and the DC power supply when the thermostat is closed and the pulsation switch is open. The small current flow is necessary to maintain the operation of the timer means without actuating the gas valve.

The present invention provides apparatus for controlling the operation of a gas valve in a gas heating system which eliminates many of the prior art deficiencies in systems which are complicated and unreliable because of false triggering problems. Some prior art systems will not operate with electronic thermostats. Other prior art systems require separate power sources to maintain operation of the timer means during the time when the contacts of the thermostat are open.

SUMMARY OF THE INVENTION

The present invention provides apparatus for controlling the operation of a gas valve in a gas heating system which includes thermostatic switch means and a source of AC voltage which are connected to form a series circuit with the gas valve. The apparatus comprises switch means which is connected to provide continuity in the series circuit upon receipt of a first control signal and to remove the continuity in the series circuit upon removal of the first control signal. Isolation means receives a second control signal having a high state and an alternate low state and generates the first control signal when receiving the high state of the second control signal. A power supply receives the AC voltage when the thermostatic switch means is closed and provides a DC voltage to a timer means. The timer means then generates the second control signal. When the temperature detected by the thermostatic switch means is below a selected setting, the thermostatic switch means provides continuity which results in the AC voltage being applied to the power supply which then provides DC voltage to the timer means. Upon the application of the DC voltage, the output of the timer means is in the high state for a first predetermined time. At the end of the first predetermined time, the output is in the low state for a second predetermined time and is then in the high state for a third predetermined time. The output of the timer means then alternates between the high and low states for the second and third predetermined times until the thermostatic switch means is opened.

Among the advantages offered by the present invention is an inexpensive means for providing control of the gas valve of a heating unit for the purpose of reducing the energy consumption thereof. The present invention is always triggered by the closing of the contacts of the thermostat of the heating system and does not free-run. The present invention turns "off" when the contacts of the thermostat of the heating system are open. The present invention provides isolation of the AC circuitry and the DC circuitry and minimizes any false triggering. The present invention works with the electronic set-back type thermostats. The present invention does not require a battery. The present invention allows the full value of AC voltage, switched by the thermostat, to be applied to the gas valve. The present invention automatically isolates itself when the thermostat is in the "off" position or condition.

Examples of the more important features and advantages of this invention have thus been summarized rather broadly in order that the detailed description thereof that follows may be better understood and in order that the contribution to the art may be better appreciated. There are, of course, additional features of the invention which will be described hereinafter and which will also form the subject of the claims appended hereto. Other features of the present invention will become apparent with reference to the following detailed description of a presently preferred embodiment thereof in connection with the accompanying drawing in which:

DESCRIPTION OF THE PREFERRED EMBODIMENT

Figure 1:
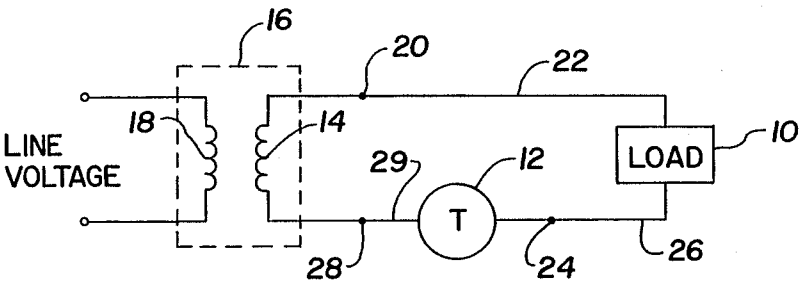
FIG. 1 is a simplified schematic diagram of the control portion of a typical heating system of the prior art.

Referring now to the drawing wherein like reference numerals designate like or corresponding elements throughout the several views, the prior art control system of a typical heating system or furnace for a building or dwelling disclosed in FIG. 1 consists of an electrical series circuit of an energy consuming device or load 10, thermostat 12 (passive or electronic type) and the secondary winding 14 of isolation transformer 16. Energy consuming device or load 10 is connected to terminal 20 of secondary winding 14 by lead 22 and to terminal 24 of thermostat 12 by lead 26. Thermostat 12 is connected to terminal 28 of secondary winding 14 by lead 29. Load 10 may be a solenoid, a relay or other control actuating means for activating a device (gas valve) for allowing the energy producing means (gas) to be applied to the energy consuming unit (gas burner). In the disclosed embodiment, load 10 is the coil of the gas valve which allows gas to flow to the gas burner in the furnace. Power for the load 10 is supplied through isolation transformer 16 which steps the normal household 115 volt 60 cycle AC power applied to primary winding 18 down to 24 volt 60 cycle AC at the secondary winding 14. When there is not any need for heat to be produced by the furnace, there is an open circuit at the thermostat 12 and the 24 volt output of the isolation transformer 16 appears at the terminals or contacts of the thermostat 12. When the temperature drops to the point where the contacts of thermostat 12 close, there is a short circuit across the thermostat 12 and the output voltage of the isolation transformer 16 appears across the load 10 to operate the gas valve of the furnace but no voltage appears across the short circuit of the thermostat 12.

As previously discussed, the load 10 remains activated until the thermostat 12 breaks the series circuit and the load 10 is deactivated. Of course, during the time that the load 10 is continuously activated, heat is lost up the flue of the furnace resulting in loss of energy for heating the building or home.

Figure 2:
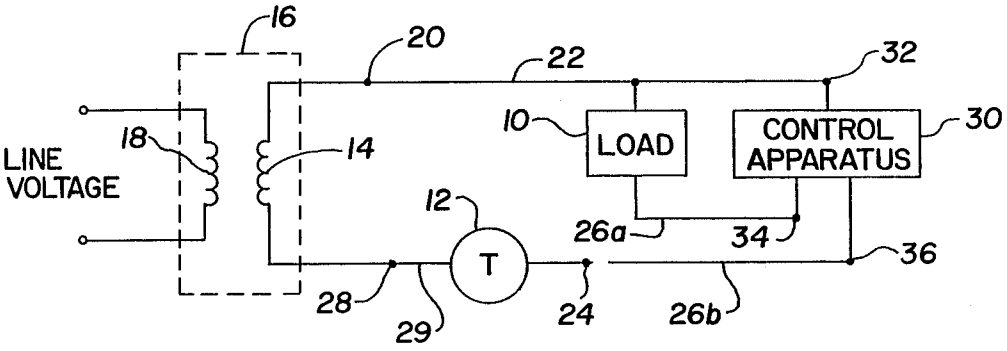
FIG. 2 is a simplified block diagram schematic of the prior art system of FIG. 1 incorporating the present invention.

Referring now to FIG. 2, there is shown the prior art system of FIG. 1 with the control apparatus 30 of the present invention incorporated into the series circuit. Lead 22 is extended and connected to terminal 32 of control apparatus 30. Lead 26 is broken into lead **26*a* and lead 26*b* with lead 26*a* being connected between load 10 and terminal 34 of control apparatus 30. Lead 26*b* is connected between terminal 36 of control apparatus 30 and terminal 24 of thermostat 12**.

The efficiency of the furnace can be vastly improved by reducing the average temperature of the heat exchanger wall so that more heat can be extracted from the combustion products before leaving the furnace to travel up the flue. One means to accomplish this is to cause the furnace to burn in cycles which allows the heat exchanger walls to heat up and cool off but limit the heat-up or on-cycle to a time which is not long in relation to the thermal time constant of the heat exchanger. The temperature of the combustion products leaving the furnace is reduced by maintaining a lower temperature on the interior surface of the heat exchanger.

A higher percentage of the combustion heat is transferred to the heat exchanger when the walls are relatively cool and this concept is incorporated into the present invention which automatically controls a typical home furnace via electronic circuitry which functions to cyclically turn on and off the gas valve during the time that the thermostat 12 is calling for heat to be provided to the dwelling.

When the temperature detected by the thermostat goes below a selected setting, the thermostat sends a signal (applies the 24 volts AC) to the control apparatus 30 to activate same. Upon activation, control apparatus 30 completes the series circuit thereby taking control of the load 10 (the gas valve) and applies the 24 volts AC to the load 10. Upon initial activation by the thermostat 12, control apparatus 30 initially activates the load 10 for a first predetermined time to allow the heat exchanger to attain a first predetermined temperature. Sometime during this first predetermined time, the fan in the furnace is turned on to circulate air across the heat exchanger. At the end of the first predetermined time, the control apparatus 30 removes the 24 volts AC and deactivates the load 10 for a second predetermined time. At the end of the second predetermined time, the control apparatus 30 again applies the 24 volts AC and activates the load 10 for a third predetermined time. At the end of the third predetermined time, the control apparatus 30 continues to cycle the load 10 on and off in accordance with the second and third predetermined times until the thermostat senses that the desired temperature has been reached and opens the series circuit to deactivate control apparatus 30 which then deactivates the load 10 (gas valve) and shuts down the furnace.

In the preferred embodiment, the first predetermined time is approximately 145 seconds (initial ON time), the second predetermined time is approximately 30 seconds (cycle OFF time) and the third predetermined time is approximately 90 seconds (cycle ON time). The control apparatus 30 will work in conjunction with any electronic thermostat as well as with any passive thermostat and receives operating power from the isolation or control transformer of the heating system via the thermostat. The control apparatus 30 is completely isolated from the heating system when the thermostat is in the OFF condition (contacts are open) and turns on the gas valve of the furnace only when it receives a signal from the thermostat. The control apparatus 30 allows the gas burner to remain on (initially) for about 145 seconds and then pulses the gas burner (only) OFF for about 30 seconds and ON for about 90 seconds.

Figure 3:
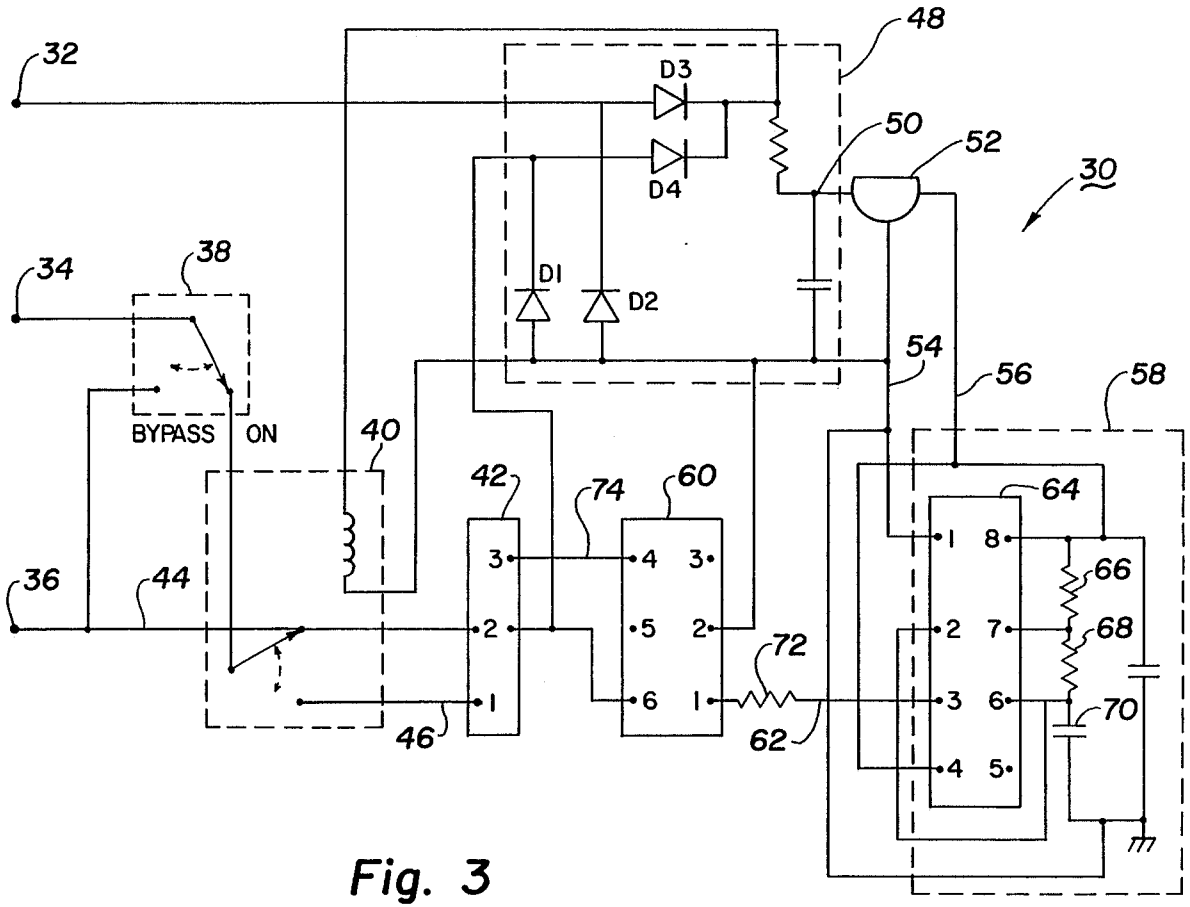
FIG. 3 is a simplified schematic of one embodiment of the present invention.

With reference to FIG. 3, one embodiment of control apparatus 30 is disclosed which includes an on/bypass switch 38 and an isolation relay 40. The function of the on/bypass switch 38 is to allow the control apparatus 30 to be switched in or out of the series control circuit for the heating system. The on/bypass switch 38 has a first mode and a second mode of operation. In the first mode of operation, which is the "on" mode or position, on/-bypass switch 38 (in conjunction with isolation relay 40) provides an electrical path to apply the output of switch means 42 across terminals 34 and 36. In the second mode of operation, which is the "bypass" mode or position, on/bypass switch 38 provides a short between terminals 34 and 36 which bypasses control apparatus 30 and removes the control apparatus 30 from the series circuit. In the preferred embodiment, on/bypass switch 38 comprises a SPDT switch.

Isolation relay 40 is provided so the control apparatus 30 may be used with an electronic set-back thermostat which requires a charging-type current when the heating system is in the off condition. If the isolation relay 40 was not provided, control apparatus 30 would provide a discontinuity in the series circuit when the furnace was off and the 24 volts AC would not appear at the terminals of the electronic set-back thermostat. In the preferred embodiment, isolation relay 40 is a SPDT type which is activated when 24 volts (nominal) DC is applied to its coil. When the thermostat 12 is in the OFF condition or position, isolation relay is not energized and the wiper arm thereof is in contact with lead 44 which results in terminals 34 and 36 being connected thereby allowing the 24 volts AC to be applied to the terminals of the thermostat 12. When thermostat 12 in the ON condition or position, isolation relay is energized and the wiper arm thereof is in contact with lead 46 to provide an electrical path to apply the output of switch means 42 across terminals 34 and 36.

With further reference to FIG. 3, when the thermostat 12 is in the ON condition or position, the 24 volts AC then appears across terminals 32 and 36 and is applied to the input of power supply 48. In the preferred embodiment, power supply 48 is a conventional four diode (D1–D4) bridge rectifier power supply whose unregulated output of approximately 24 volts DC appears at terminal 50. The 24 volts DC activates isolation relay 40 which places the wiper arm thereof in contact with lead 46 to place the output of switch means 42 in the series control circuit for the heating system.

The output of power supply 48 is applied to voltage regulator 52 which provides a regulated output of 5 volts plus or minus 0.25 volts DC across terminals 54 and 56. In the preferred embodiment, voltage regulator 52 comprises a microcircuit voltage regulator whose input voltage can range from 6.7 volts to 30 volts.

The output of voltage regulator 52 is applied to timer means 58 whose output in the form of a second control signal is applied to isolation means 60 via lead 62 and isolation resistor 72. In the preferred embodiment, timer means 58 comprises a 555 timer chip 64 which is connected to operate as an a stable multivibrator whose frequency and duty cycle are controlled by resistors 66 and 68 and timing capacitor 70. When the 5 volt DC output of voltage regulator 52 is initially applied across terminals 54 and 56, the output (in the form of the second control signal) of the 555 timer chip 64 on lead 62 to isolation means 60 goes high and stays high for a period of time determined by:

$$t_1 = 1.1\ (\text{resistor } 66 + \text{resistor } 68)\ (\text{capacitor } 70)$$

where $t_1$ is the first predetermined time when the second control signal will be in the high state and is considered the initial ON time. At the end of this first predetermined time, the voltage on the timing capacitor 70 will have reached $\frac{2}{3}$ of the 5 volts DC and the internal flip-flop in the 555 timer chip 64 will be triggered and the timing capacitor 70 will begin to discharge through resistor 68 to pin 7 of the 555 timer chip 64.

The time that it takes for the timing capacitor 70 to discharge to $\frac{1}{3}$ of the 5 volts DC is $t_2$ and is determined by:

$$t_2 = 0.693\ (\text{resistor } 68)\ (\text{timing capacitor } 70)$$

where $t_2$ is the second predetermined time when the second control signal will be in low state and is considered the cycle OFF time. As the value of the voltage on the timing capacitor 70 reaches $\frac{1}{3}$ of the 5 volts DC, the 555 timer chip 64 retriggers itself and timing capacitor 70 starts to charge up to $\frac{2}{3}$ of the 5 volts DC. The time that it takes for the timing capacitor 70 to charge to $\frac{2}{3}$ of the 5 volts DC is $t_3$ and is determined by:

$$t_3 = 0.693\ (\text{resistor } 66 + \text{resistor } 68)\ (\text{timing capacitor } 70)$$

where $t_3$ is the third predetermined time when the second control signal will be in the high state and is considered the cycle ON time. $t_3$ is less than $t_1$ because the charging of the timing capacitor 70 is not starting from zero volts but is starting from $\frac{1}{3}$ of 5 volts DC.

When the output (in the form of the second control signal) of the timer means 58 to isolation means 60 goes high, the output of isolation means 60 on lead 74 to switch means 42 gates switch means 42 to the ON condition which provides continuity between leads 44 and 46 (between terminals 2 and 1 of switch means 42). When the output (in the form of the second control signal) of the timer means 58 goes low, the continuity between leads 44 and 46 is removed. In the preferred embodiment, isolation means 60 comprises an opto coupler/isolator which provides very high isolation between the input and output thereof. In the preferred embodiment, switch means 42 comprises a triac which is a solid state AC switch which is turned ON and OFF by the application of a trigger voltage to the gate terminal (terminal 3). The output of the switch means 42 follows the timing cycle of timer means 58.

Figure 4:
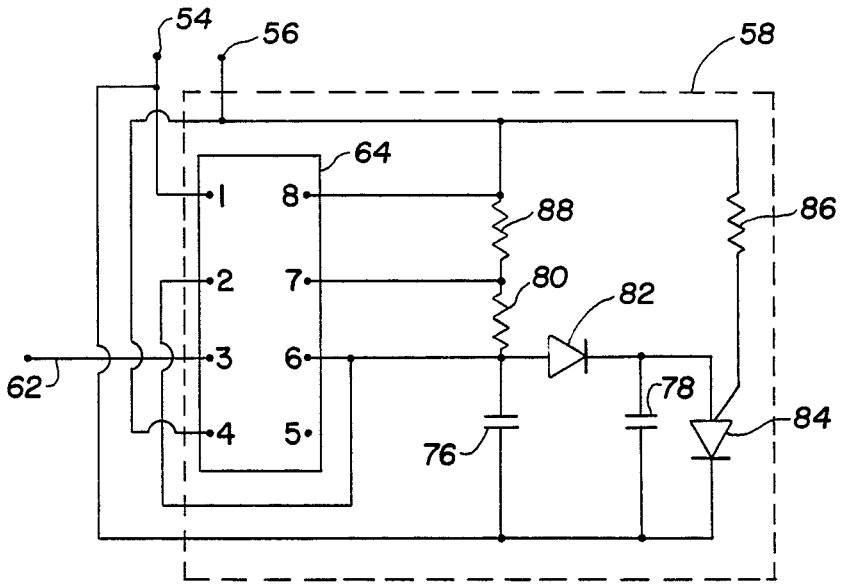
FIG. 4 is a simplified schematic of another embodiment of the timer means of the present invention.

With reference to FIG. 4, another embodiment of the timer means 58 is disclosed which provides a longer initial ON time (first predetermined time) for switch means 42 with the subsequent OFF and ON cycle times being substantially as they were in the previous embodiment. When the 5 volt DC output of voltage regulator 52 is initially applied across terminals 54 and 56, the output of the 555 timer chip 64 on lead 62 goes high and stays high until the voltage on the timing capacitor 76 reaches $\frac{2}{3}$ of the 5 volts DC and the voltage on capacitor 78 reaches $\frac{2}{3}$ of the 5 volts DC minus the one diode voltage drop of diode 82. The charging path for timing capacitor 76 being through resistors 80 and 88 while the charging path for capacitor 78 is through resistors 80 and 88 and diode 82. Only timing capacitor 76 contributes to the OFF and ON cycle times. Capacitor 78, after being charged, remains isolated by diode 82 (which is reversed biased) and unijunction transistor 84, which has the 5 volts DC supply voltage applied to its gating terminal (emitter) through resistor 86. Capacitor 78 is discharged through unijunction transistor 84 when the 5 volt supply voltage is removed. When the voltage at terminal 6 of the 555 timer chip 64 reaches $\frac{2}{3}$ of the 5 volts DC, timing capacitor 76 is discharged to $\frac{1}{3}$ of the 5 volts DC through resistor 80 to determine the OFF cycle time. The ON cycle time is then determined by the time required for timing capacitor 76 to charge from $\frac{1}{3}$ to $\frac{2}{3}$ of the 5 volts DC through resistors 80 and 88.

Figure 5:
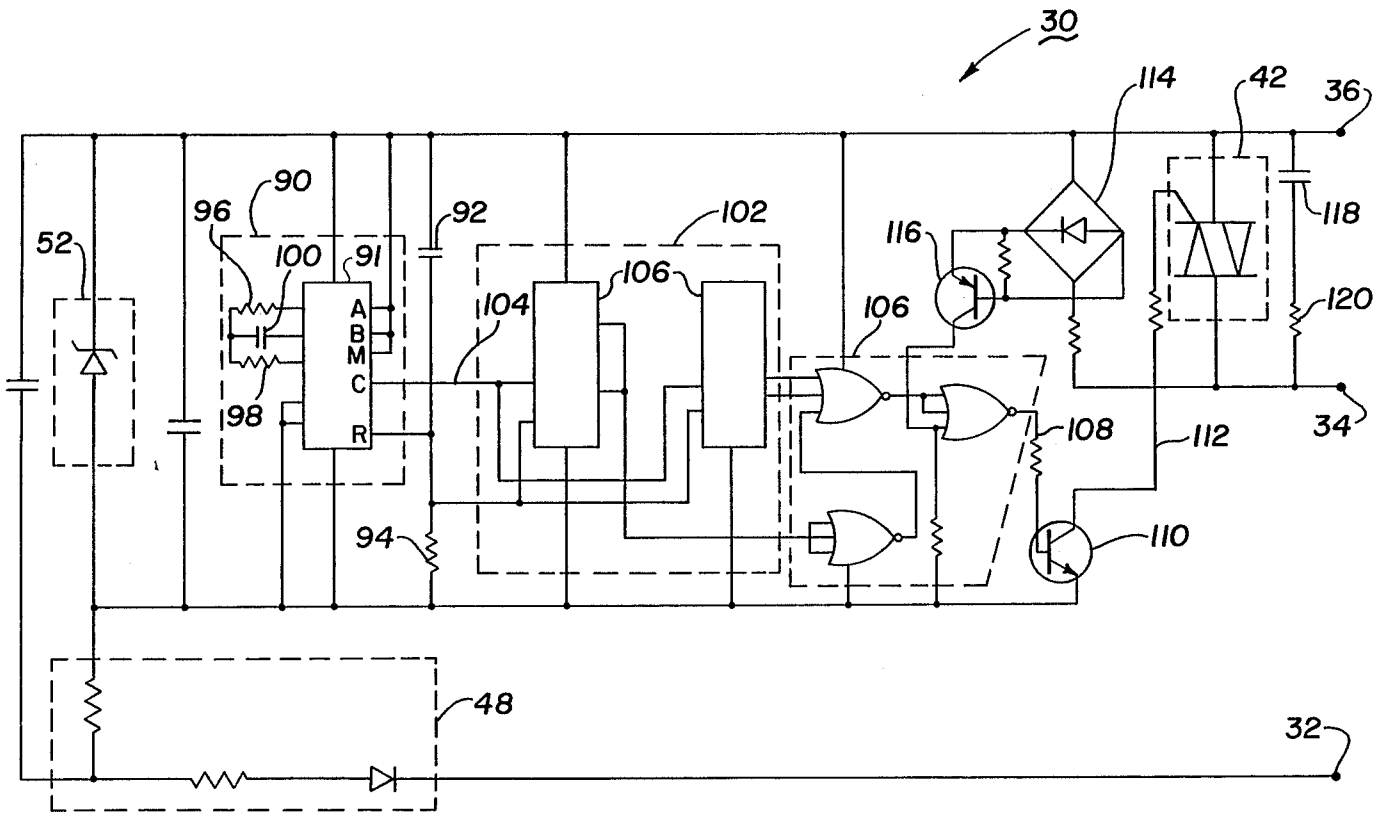
FIG. 5 is a simplified schematic of another embodiment of the present invention.

With reference to FIG. 5, another embodiment of the control apparatus is disclosed which embodies digital circuitry. The on/bypass switch 38 and the isolation relay 40 are not shown in this figure but it would be appreciated that they could be incorporated therein similar to their incorporation in FIG. 3. When thermostat 12 is in the ON condition or position, the 24 volts AC then appears across terminals 32 and 36 and is applied to the input of power supply 48. The 5 volts DC from voltage regulator (zener diode) 52 is applied to clock means 90. In the preferred embodiment, clock means 90 is a CMOS 24 ST frequency divider 91 (MC-14521). The initial ON time (first predetermined time) is determined by capacitor 92 and resistor 94. The clock rate of clock means 90 is determined by resistors 96 and 98 and capacitor 100. Counter means 102 receives the output signal from clock means 90 on lead 104. In the preferred embodiment, counter means 102 comprises a CMOS dual binary up-counter chip 106 (MC-14520) and the cycle OFF time and the cycle ON time are determined by counter means 102 by dividing-down the clock rate of clock means 90.

The output of counter means 102 is input to first gating means 106 whose output on lead 108 activates second gating means 110. The output of second gating means 110 on lead 112 triggers switch means 42 to the ON condition or position thereby connecting terminals 34 and 36 together which results in control apparatus 30 being connected in the series control circuit for the heating system.

Zero cross-over detector 114 suppresses signals of interference which may be generated and also suppresses any back emf generated in the circuit of control apparatus 30 when the contacts of thermostat 12 are opened and closed resulting in the application and removal of the 24 volts AC in the series control circuit for the heating system. These unwanted signals are diverted to ground through third gating means 116 and first gating means 106. Capacitor 118 and resistor 120 provide snubber action for the switch means 42 since a transistor (second gating means 110) is used to trigger switch means 42 in this embodiment.

Figure 6:
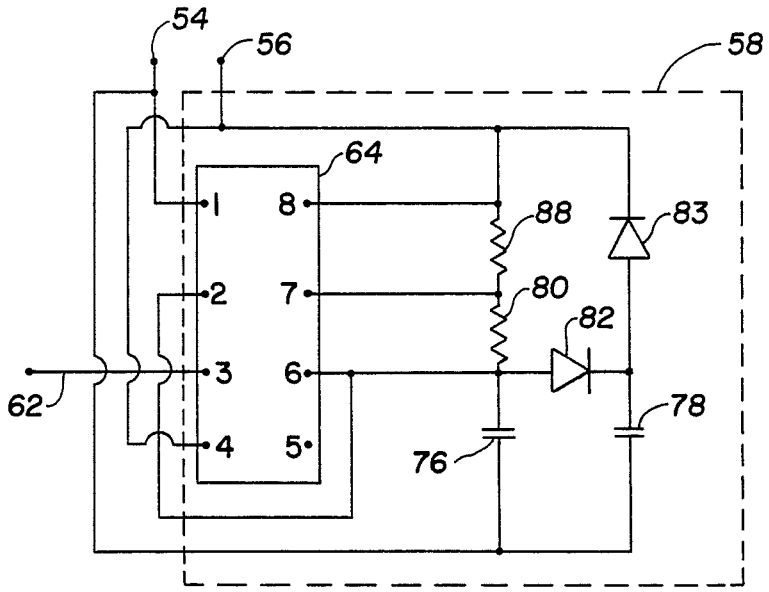
FIG. 6 is a simplified schematic of another embodiment of timer means of the present invention.

With reference to FIG. 6, another embodiment of the timer means 58 is disclosed which provides a longer initial ON time (first predetermined time) for switch means 42 with the subsequent OFF and ON cycle times being substantially as they were in the previous embodiment. When the 5 volt DC output of voltage regulator 52 is initially applied across terminals 54 and 56, the output of the 555 timer chip 64 on lead 62 goes high and stays high until the voltage on the timing capacitor 76 reaches $\frac{2}{3}$ of the 5 volts DC supply voltage and the voltage on capacitor 78 reaches $\frac{2}{3}$ of the 5 volts DC supply voltage minus the one diode voltage drop of diode 82. The charging path for timing capacitor 76 being through resistors 80 and 88 while the charging path for capacitor 78 is through resistors 80 and 88 and diode 82. Only timing capacitor 76 contributes to the OFF and ON cycle times. Capacitor 78 after being charged remains isolated by diode 82 (which is reversed biased) and diode 83 (which has the 5 volts DC applied to the cathode thereof). Capacitor 78 will be discharged through diode 83 when the 5 volt DC supply voltage is removed. When the voltage at terminal 6 of the 555 timer chip 64 reaches $\frac{2}{3}$ of the 5 volts DC, timing capacitor 76 is discharged to $\frac{1}{3}$ of the 5 volts DC through resistor 80 to determine the OFF cycle time. The ON cycle time is then determined by the time required for timing capacitor 76 to charge from $\frac{1}{3}$ to $\frac{2}{3}$ of the 5 volts DC through resistors 80 and 88.

Figure 7:
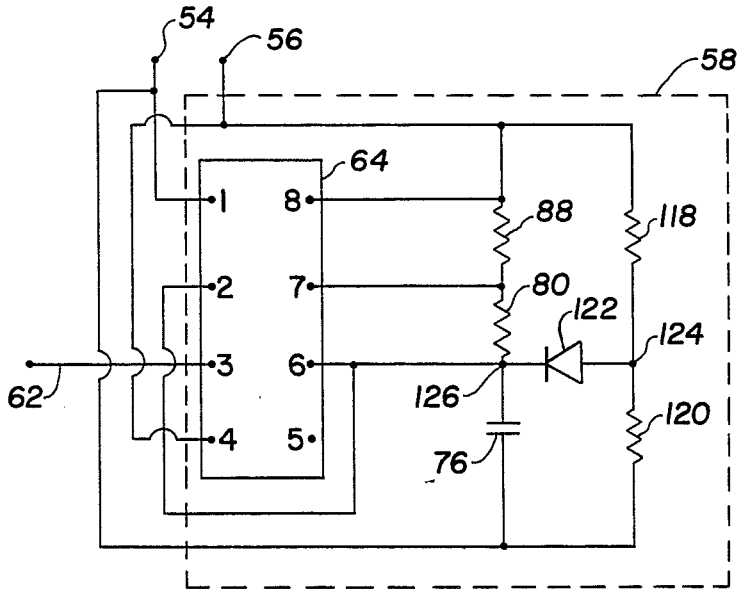
FIG. 7 is a simplified schematic of an additional embodiment of the timer means of the present invention.

With reference to FIG. 7, another embodiment of the timer means 58 is disclosed which provides a shorter initial ON time (first predetermined time) for switch means 42 with the subsequent OFF and ON cycle times being as they were in the previous embodiment. When the 5 volt DC output of voltage regulator 52 is initially applied across terminals 54 and 56, the output of the 555 timer chip 64 on lead 62 goes high and the voltage divider network comprising resistor 118 and 120 together with diode 122 causes the timing capacitor 76 to initially charge very rapidly to the voltage applied to terminal 126 from terminal 124. The ratio of the values of resistors 118 and 120 is chosen such that the voltage at terminal 126 (taking into account the voltage drop introduced by diode 122) is a desired value (which is dependant upon the amount of initial ON time desired) between zero and $\frac{1}{3}$ of the 5 volts DC supply voltage. After the initial fast charge through the voltage divider and diode 122, timing capacitor 76 continues to charge toward $\frac{2}{3}$ of the 5 volts DC through resistors 88 and 80. When the voltage on the timing capacitor 76 (terminal 126) reaches $\frac{2}{3}$ of the 5 volts DC, the output on lead 62 goes low and timing capacitor 76 is discharged to $\frac{1}{3}$ of the 5 volts DC through resistor 80 to pin 7 of the 555 timer chip 64.

Thus it is apparent that there has been provided, in accordance with this invention, apparatus that substantially incorporates the features and advantages set forth above. The initial ON time may be adjusted for various types of installations of heating systems and for various sizes and types of heating systems to assure that the heat exchanger will be brought up to the proper and most efficient temperature during the initial heating period.

Although the present invention has been described herein with reference to specific forms thereof, it is evident that many alternatives, modifications and variations will become apparent to those skilled in the art in light of the foregoing disclosure. Accordingly, this description is to be construed as illustrative only and is for the purpose of teaching those skilled in the art the manner of carrying out the invention. It is to be understood that the forms of the invention herewith shown and described are to be taken as the presently preferred embodiments. Various changes may be made in the shape, size and arrangement of parts. For example, equivalent elements may be substituted for those illustrated and described herein, parts may be reversed, and certain features of the invention may be utilized independently of other features of the invention. It will be appreciated that various modifications, alternatives, variations, etc., may be made without departing from the spirit and scope of the invention as defined in the appended claims.

What is claimed is:

1. Apparatus for controlling the operation of a gas valve in a gas heating system which includes thermostatic switch means and a source of AC voltage which are operatively connected to form a series circuit with said gas valve such that said gas valve is activated by said AC voltage to allow gas to flow to a gas burner in said gas heating system when said thermostatic switch means is activated to the closed position, said apparatus comprising:

switch means operatively connected to provide continuity in said series circuit upon receipt of a first control signal and to remove said continuity in said series circuit upon removal of said first control signal;

isolation means operatively connected to receive a second control signal having a high state and an alternate low state, said isolation means being structured to generate said first control signal when receiving the high state of said second control signal and being operatively connected to apply said first control signal to said switch means;

a power supply operatively connected to receive said AC voltage and to provide a DC output voltage of predetermined value;

timer means structured to generate said second control signal upon receiving, as an input, said DC output voltage from said power supply; and relay means including an activating coil which is operatively connected to be activated by said DC output of said power supply and further including contact means operatively connected to place the output of said switch means in said series circuit with said gas valve when said thermostatic switch means is closed and said activating coil is activated and to remove the output of said switch means in said series circuit with said gas valve when said thermostatic switch means is open and said activating coil is not activated, said contact means providing continuity in said series circuit with said gas valve when said output of said switch means is removed from said series circuit with said gas valve.

2. The apparatus of claim 1 wherein said timer means includes means for determining a first predetermined time when said second control signal will be in the high state upon application of the DC output voltage from said power supply.

3. The apparatus of claim 2 wherein said timer means includes means for determining a second predetermined time when said second control signal will be in the low state following said first predetermined time.

4. The apparatus of claim 3 wherein said timer means includes means for determining a third predetermined time when said second control signal will be in the high state following said second predetermined time.

5. The apparatus of claim 2 wherein said timer means includes a 555 timer chip and said means for determining a first predetermined time includes a first series circuit comprising a first resistor, a second resistor and a first capacitor operatively connected across the DC output of said power supply with the connection between the second resistor and the first capacitor being connected to the threshold terminal of the 555 timer chip, a second series circuit being operatively connected across said first capacitor, said second series circuit comprising a first diode and a second capacitor with the anode terminal of said first diode being operatively connected to the connection between the second resistor and the first capacitor.

6. The apparatus of claim 5 further including a unijunction transistor connected in parallel with said second capacitor with base 1 being operatively connected to the connection between said first diode and said second capacitor and base 2 being operatively connected to the negative terminal of the DC power supply, the emitter terminal of said unijunction transistor being operatively connected to the plus 5 volts of the DC power supply.

7. The apparatus of claim 5 further including a second diode operatively connected between the connection of the first diode and the second capacitor and the plus 5 volts of the DC power supply with the cathode terminal of the second diode being connected to said plus 5 volts.

8. The apparatus of claim 2 wherein said timer means includes a 555 timer chip and said means for determining a first predetermined time includes a first series circuit comprising a first resistor, a second resistor and a first capacitor operatively connected across the DC output of said power supply with the connection between the second resistor and the first capacitor being connected to the threshold terminal of the 555 timer chip, a third series circuit being operatively connected across the DC output of said power supply and in parallel with said first series circuit, said third series circuit comprising a third resistor and a fourth resistor, a second diode being operatively connected between the connection between the second resistor and the first capacitor and the connection between the third resistor and the fourth resistor, the anode terminal of said second diode being operatively connected to the connection between the third resistor and the fourth resistor.

9. The apparatus of claim 8 wherein said first switch means comprises a triac.

10. The apparatus of claim 1 wherein said switch means comprises a triac.

11. The apparatus of claim 1 wherein said isolation means comprises an opto coupler/isolator.

12. The apparatus of claim 1 wherein said timer means comprises an a stable multivibrator.

13. Apparatus for controlling the operation of a gas valve in a gas heating system which includes thermostatic switch means and a source of AC voltage which are operatively connected to form a series circuit with said gas valve such that said gas valve is activated by said AC voltage to allow gas to flow to a gas burner in said gas heating system when said thermostatic switch means is activated to the closed position, said apparatus comprising:

first switch means operatively connected to provide continuity in said series circuit upon receipt of a first control signal and to remove said continuity in said series circuit upon removal of said first control signal;

second switch means operatively connected to provide said first control signal upon receipt of a second control signal;

gating means structured to generate and operatively connected to provide said second control signal to said second switch means upon receipt of a third control signal;

counter means structured to receive a clock signal of a predetermined frequency and to provide said third control signal to said gating means;

clock means structured to generate said clock signal of a predetermined frequency upon the application of a DC voltage of predetermined value and operatively connected to said counter means to provide said clock signal of a predetermined frequency thereto; and a power supply operatively connected to receive said AC voltage and to provide a DC output voltage of predetermined value to said clock means.

14. The apparatus of claim 13 wherein said second switch means comprises a transistor.

15. The apparatus of claim 13 further including a zero cross-over detector operatively connected across the output of said first switch means.

16. The apparatus of claim 13 further including snubber means operatively connected across the output of said first switch means.

17. A method of controlling the operation of a gas valve in a gas heating system which includes thermostatic switch means and a source of AC voltage which are operatively connected to form a series circuit with said gas valve such that said gas valve is activated by said AC voltage to allow gas to flow to a gas burner in said gas heating system when said thermostatic switch means is activated to the closed position, said method comprising the steps of:

(a) providing apparatus for controlling which includes switch means operatively connected in series with said thermostatic switch means, said source of AC voltage and said gas valve;

(b) activating the apparatus for controlling by closing said thermostatic switch means;

(c) activating the switch means, in the apparatus for controlling, for a first predetermined time to activate the gas valve and let the heat exchanger in the gas heating system attain a predetermined temperature;

(d) deactivating the switch means, in the apparatus for controlling, for a second predetermined time to deactivate the gas valve and let the heat exchanger in the gas heating system cool down from said predetermined temperature, said second predetermined time being less than said first predetermined time;

(e) activating the switch means, in the apparatus for controlling, for a third predetermined time to active the gas valve and let the heat exchanger in the gas heating system increase in temperature toward said predetermined temperature, said third predetermined time being between said first and said second predetermined time; and (f) repeating steps (d) and (e) until said thermostatic switch means is opened.

18. The method according to claim 17 wherein said first predetermined time is approximately 145 seconds.

19. The method according to claim 17 wherein said second predetermined time is approximately 30 seconds.

20. The method according to claim 17 wherein said third predetermined time is approximately 90 seconds.

* * * * *